US007156580B2

(12) United States Patent
Suazo et al.

(10) Patent No.: US 7,156,580 B2
(45) Date of Patent: Jan. 2, 2007

(54) INTERLOCKABLE DRAINAGE SYSTEM

(75) Inventors: Kenneth L. Suazo, Espanola, NM (US); Isaac Suazo, Vallecitos, NM (US); Dawn S. Harder, Tijeras, NM (US); Juan Griego, Vallecitos, NM (US); Julian Suazo, Vallecitos, NM (US)

(73) Assignee: FastDitch, Inc., Espanola, NM (US)

( * ) Notice: Subject to any disclaimer, the term of this patent is extended or adjusted under 35 U.S.C. 154(b) by 56 days.

(21) Appl. No.: 11/114,546

(22) Filed: Apr. 26, 2005

(65) Prior Publication Data

US 2005/0186031 A1 Aug. 25, 2005

Related U.S. Application Data

(60) Continuation-in-part of application No. 10/837,213, filed on Apr. 30, 2004, which is a continuation-in-part of application No. 10/731,315, filed on Dec. 8, 2003, now Pat. No. 7,025,532, which is a division of application No. 10/453,673, filed on Jun. 3, 2003, now Pat. No. 6,722,818, which is a continuation-in-part of application No. 10/316,756, filed on Dec. 11, 2002, now Pat. No. 6,692,186.

(51) Int. Cl.
*E02B 5/02* (2006.01)

(52) U.S. Cl. ..... 405/118; 405/119; 405/121; 405/270

(58) Field of Classification Search ..... 405/118–126, 405/270, 268
See application file for complete search history.

(56) References Cited

U.S. PATENT DOCUMENTS 195,989 A * 10/1877 Culver ..... 405/119
856,702 A * 6/1907 Howley ..... 405/118
3,156,099 A * 11/1964 Dailey ..... 405/270
3,446,025 A * 5/1969 Koch ..... 405/121
3,854,292 A * 12/1974 Nienstadt ..... 405/270
6,227,763 B1 * 5/2001 Kuhns ..... 405/119
6,692,186 B1 2/2004 Suazo et al.
6,722,818 B1 4/2004 Suazo et al.

OTHER PUBLICATIONS

U.S. Appl. No. 10/837,213, filed Apr. 30, 2004, Suazo et al.

* cited by examiner

*Primary Examiner*—Frederick L. Lagman
(74) *Attorney, Agent, or Firm*—Ray R. Regan

(57) ABSTRACT

The specification and drawing figures describe and show an interlockable drainage system insertable into a ditch that includes two or more liner sections. Each liner section includes a plurality of corrugations that are asymmetrical. The interlockable drainage system also includes a flared channel extending from opposing edges of the liner sections. A shoulder is formed in the opposing ends of the liner sections. A plurality of bosses is formed on the shoulder. The plurality of bosses on one shoulder is compressibly connectable to the plurality of bosses on an opposing shoulder, thus connecting one liner section to another. A connector is provided for added interconnectability of the plurality of bosses. This abstract is provided to comply with rules requiring an abstract that will allow a searcher or other reader to quickly ascertain the subject matter of the technical disclosure, but this abstract is not to be used to interpret or limit the scope or meaning of any claim.

32 Claims, 10 Drawing Sheets

INTERLOCKABLE DRAINAGE SYSTEM

CROSS-REFERENCE TO RELATED APPLICATION

This application is a continuation-in-part from continuation-in-part application Ser. No. 10/837,213, filed Apr. 30, 2004, which is a continuation-in part application of divisional application Ser. No. 10/731,315 filed Dec. 8, 2003, now U.S. Pat. No. 7,025,532 which was a divisional application of application Ser. No. 10/453,673 filed on Jun. 3, 2003 that matured into U.S. Pat. No. 6,722,818 B1 issued on Apr. 20, 2004, which itself was a continuation-in-part of parent U.S. application Ser. No. 10/316,756 filed Dec. 11, 2002 that matured into U.S. Pat. No. 6,692,186 B1, issued Feb. 17, 2004. The specification and disclosures of U.S. Pat. No. 6,692,186 B1, of U.S. Pat. No. 6,722,818 B1, and co-pending divisional application Ser. No. 10/731,315 are incorporated by reference into this document.

FIELD OF TECHNOLOGY

The apparatus and method disclosed and claimed in this document pertain generally to a system for draining and transporting fluids, including water, and fluid mixtures and admixtures containing undesirable solids, gases, trash, dirt, toxins, contaminants, and a wide range of other solids, fluids, gases and other undesirable matter (collectively, in this document, "undesirable fluids and materials") to a containment, collection, or disposal location (collectively, a "containment area"). More particularly, the new and useful interlockable drainage system disclosed and claimed in this document provides inexpensive, light, portable, light-resistant, ultra-violet light-resistant, inter-connectable drainage liner sections that, when assembled, transport undesirable fluids and materials away from both land and structures on land, thus avoiding the adverse results of the presence of undesirable fluids and materials. The interlockable drainage system is particularly, but not exclusively, useful for drainage control in commercial and residential areas, and for solving diverse and complex conservation and water management problems.

BACKGROUND

Both stationary undesirable fluids and materials may adversely affect commercial and residential land and structures. Both the land and structures may be adversely affected by the action of undesirable fluids and materials in, against and under structures. The undesirable fluids and materials also may contaminate the land. Structures may be adversely affected by seepage of undesirable fluids and materials beneath structures because, to the extent that seepage occurs in the vicinity of concrete and other materials used to construct foundations and other components of structures, the structure may be adversely affected as more particularly described below. In addition, undesirable fluids and materials may erode open land, as well as land on which structures are constructed, adversely affecting the use, value and utility of land and structures.

Since time immemorial, a common way to both transport water and to drain undesirable fluids and materials has been the use of ditches. The term "ditch" as used in this document means any excavation dug in the earth, or any structure partially or completely installed above earth, that may be referred to as a drain, channel, canal or acequia, whether lined or unlined, that usually but not always relies on principles of gravity and gravity flow to transport fluids such as water along descending elevations of the ditch.

Since the introduction and use of combinations of Portland cement and aggregate to the construction industries, concrete-lined ditches have been used to transport fluids such as water through ditches. Examples of such installations of concrete lined ditches are shown in FIGS. 1A–1B. Concrete seemed useful because it could be formed to fit varying slopes and directions of earthen ditches. Water, however, whether freestanding or moving, that seeps into and against concrete in concrete-lined ditches often adversely affects commercial and residential structures. Examples are shown in FIGS. 1C–1D. Concrete, unfortunately, has inherent brittle tendencies to crack, and is difficult to repair in remote and challenging terrain due in part to the weight of concrete and the weight of hauling and installing equipment and vehicles. Concrete repair also may disrupt landscapes due to heavy equipment needed. Accordingly, corrosion mitigation systems, particularly in connection with concrete, are a significant goal in the construction industries.

Concrete drains manufactured from Portland cement and various aggregates are subject to deleterious damage caused at least in part by alkali-silica reactivity ("ASR"). ASR is a chemical reaction between Portland cement concrete and aggregates that in some environments, and under some conditions, may cause severe damage to concrete ditches. ASR also may expedite other reactions that in turn cause damage, such as freeze-thaw or corrosion related damage. The phenomenon has been recognized since at least 1940, but neither the mechanisms of ASR, nor solutions, yet are clearly understood.

It is known, however, that deterioration of a concrete structure such as a concrete-lined ditch is due at least in part to water absorption by a gel that forms in concrete. The term "gel" as used in connection with concrete fabrication refers to a naturally occurring silica gel that is a colloidal silica resembling course white sand, but has many fine pores, a condition that causes the gel to be extremely adsorbent. Soluble alkalis also are present in cement, and may be affected by undesirable moisture. Vulnerable sites in the silica structure may be attacked by fluid-induced activity, converting the silica to a silica gel that absorbs water or other fluids.

An important property of concrete is its tensile strength, or its ability to react to longitudinal stress. Liquids, however, are known to adversely affect tensile strength in concrete. If the tensile strength of concrete is exceeded, cracks will form and propagate from one or more alkali-silica reaction sites, weakening the concrete structure. Many if not all of these problems generally associated with ASR may be seen in concrete-lined ditches that have been constructed in situ for any length of time. In addition, concrete becomes ever more expensive, and is difficult to install and maintain.

Suggested alternatives to concrete-lined ditches or drains are apparatus manufactured of one or more metals. Metal ditch liners, however, have proven to be neither cost effective nor durable in the presence of moving or stationary fluids, particularly undesirable fluids and materials.

A need exists in the industry, therefore, for a new, useful interlockable drainage system capable of removing undesirable fluids and materials from both open land as well as land adjacent to structures, in which the components of the interlockable drainage system may be installed in unlined ditches as well as over existing concrete-lined ditches or even other ditch liners; a system that is not susceptible to alkali-silica reactivity or to other deleterious affects associated with concrete; and a system that is flexible, lightweight, long-lived, easily installed, easily maintained or replaced, and inexpensive both to install and to maintain.

SUMMARY

The interlockable drainage system for transporting undesirable fluids and materials is insertable into a ditch that is either lined or unlined. The interlockable drainage system includes two or more liner sections. In one embodiment of the system, the two or more liner sections have a generally V-shaped cross-section. The two or more liner sections are flexible, allowing horizontal and vertical displacement due to small shifts caused, for example, by tectonic events. Molding manufacturing processes, of course, allow production of liner sections for an interlockable drainage system in various geometries and sizes to accommodate any number of circumstances and conditions. Each liner section includes a plurality of corrugations. The corrugations are formed between opposing ends of the liner sections. In one embodiment of the interlockable drainage system the plurality of corrugations are asymmetrical. The asymmetrical corrugations are formed of asymmetrical plates. The terms "asymmetrical" and "asymmetrical plates" mean that the corrugations are formed of quadrilateral plates joined by alternating substantially parallel ridges and nonparallel grooves; that each quadrilateral plate includes at least two substantially right angles formed adjacent the substantially parallel ridge; and that each quadrilateral plate also includes at least two angles adjacent the nonparallel groove that are neither right angles nor equal angles.

The interlockable drainage system also includes a flared channel. The flared channel extends from opposing edges of the liner sections. The flared channel not only is useful for reducing erosion and seepage adjacent the ditch, but also provides a device for inserting anchors that secure the liner sections in place.

Shoulders are formed in the opposing ends of the liner sections. A plurality of bosses is formed on each shoulder. The plurality of bosses on a shoulder is compressibly connectable to the plurality of bosses on an opposing shoulder in another liner section, thus providing the ability to connect one liner section to another liner section in a simple, quick and effective manner. A range of alternative means may be used to connect the plurality of bosses.

It will become apparent to one skilled in the art that the claimed subject matter as a whole, including the structure of the apparatus, and the cooperation of the elements of the apparatus, combine to result in a number of unexpected advantages and utilities. The structure and co-operation of structure of the interlockable drainage system will become apparent to those skilled in the art when read in conjunction with the following description, drawing figures, and appended claims.

The foregoing has outlined broadly the more important features of the invention to better understand the detailed description that follows, and to better understand the contributions to the art. The interlockable drainage system is not limited in application to the details of construction, and to the arrangements of the components, provided in the following description or drawing figures, but is capable of other embodiments, and of being practiced and carried out in various ways. The phraseology and terminology employed in this disclosure are for purpose of description, and therefore should not be regarded as limiting. As those skilled in the art will appreciate, the conception on which this disclosure is based may be used as a basis for designing other structures, methods, and systems. The claims, therefore, include equivalent constructions. Further, the abstract associated with this disclosure is intended neither to define the interlockable drainage system, which is measured by the claims, nor intended to limit the scope of the claims.

SUMMARY OF DEFINTIONS

The following terms have the following meanings in this document:

The term "drain" and "drainage" as used in this document refers at least to the planned installation of a system components disclosed and claimed in this document to route, carry, and move undesirable fluids and materials at a desirable rate of flow from one location to another.

The term "containment area" and terms of similar import mean any outflow area where the undesirable fluids and materials no longer pose an unacceptable threat to land and structures.

The term "concrete-lined ditches" means any concrete-lined ditch, drain, or culvert.

The term "undesirable fluids and materials" means fluids, including water, and fluid mixtures and admixtures containing undesirable solids, gases, trash, dirt, toxins, contaminants, and a wide range of other solids, fluids, gases and other undesirable matter.

The term "ditch" means any excavation dug in the earth, or any structure partially or completely installed above earth, that may be referred to as a drain, channel, canal or acequia, whether lined or unlined, that usually but not always rely on principles of gravity and gravity flow to transport fluids such as water along descending elevations of the ditch.

The term "asymmetrical" and "asymmetrical plates" means that the corrugations are formed of quadrilateral plates joined by alternating substantially parallel ridges and nonparallel grooves; that each quadrilateral plate includes at least two substantially right angles formed adjacent the substantially parallel ridge; and that each quadrilateral plate also includes at least two angles adjacent the nonparallel groove that are neither right angles nor equal angles, as perhaps best shown diagrammatically in FIG. 7.

The novel features of the interlockable drainage system are best understood from the accompanying drawing, considered in connection with the accompanying description of the drawing, in which similar reference characters refer to similar parts, and in which:

DETAILED DESCRIPTION

To the extent that subscripts to numerical designations include the lower case letter "n," as in "a–n," the letter "n" is intended to express a number of repetitions of the element designated by that numerical reference and subscripts.

Figure 1A:
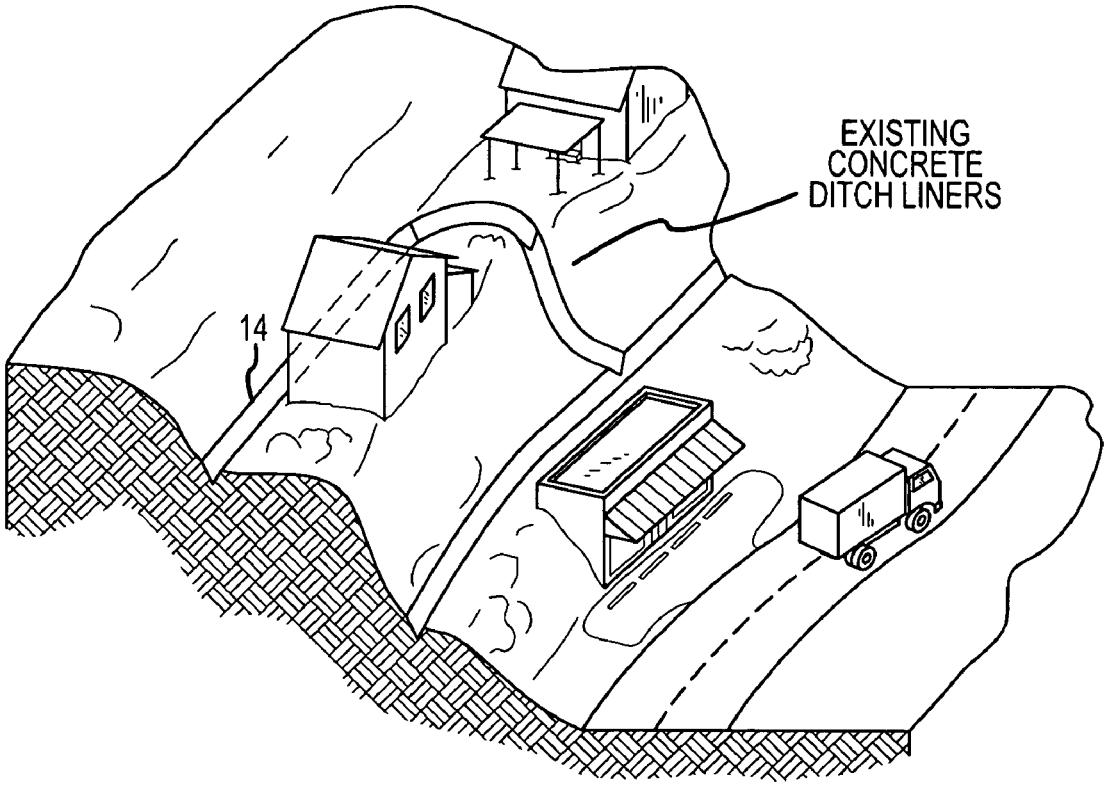
FIG. 1A is a perspective view of a representative environment in which ditches exist.
Figure 1B:
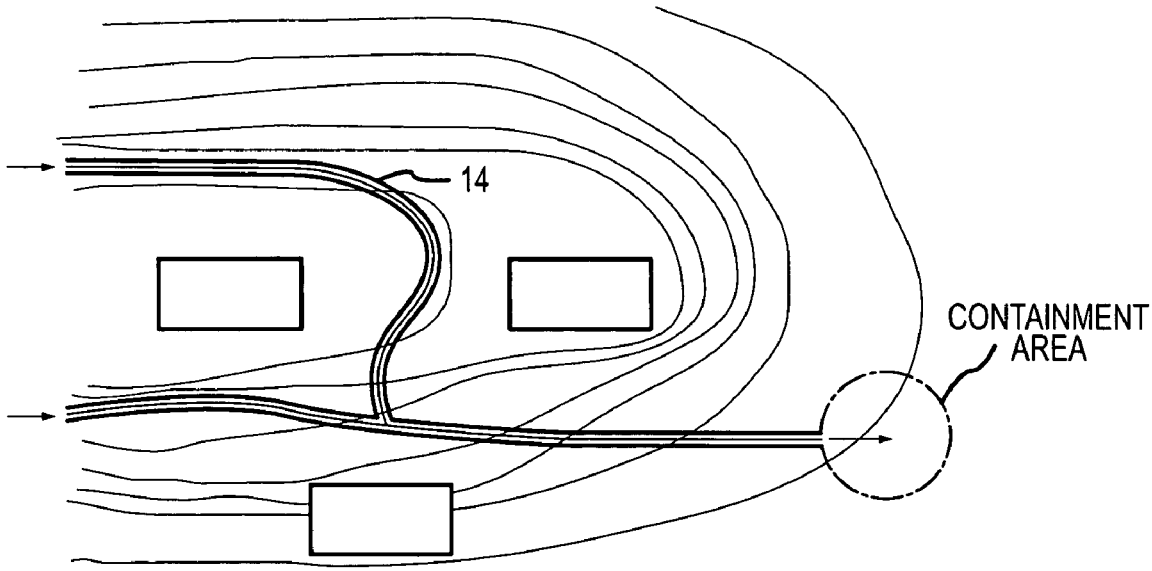
FIG. 1B is a top view of the view of a representative environment shown in FIG. 1A with contour lines.
Figure 1C:
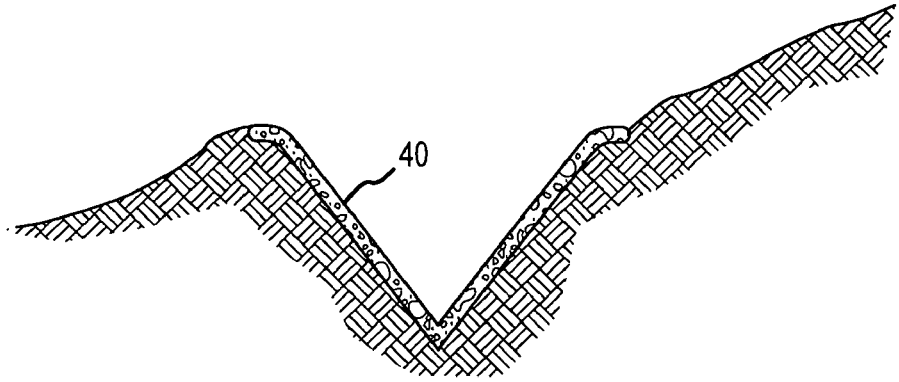
FIG. 1C is an end cut-away end view of a concrete ditch liner installed in a ditch.
Figure 1D:
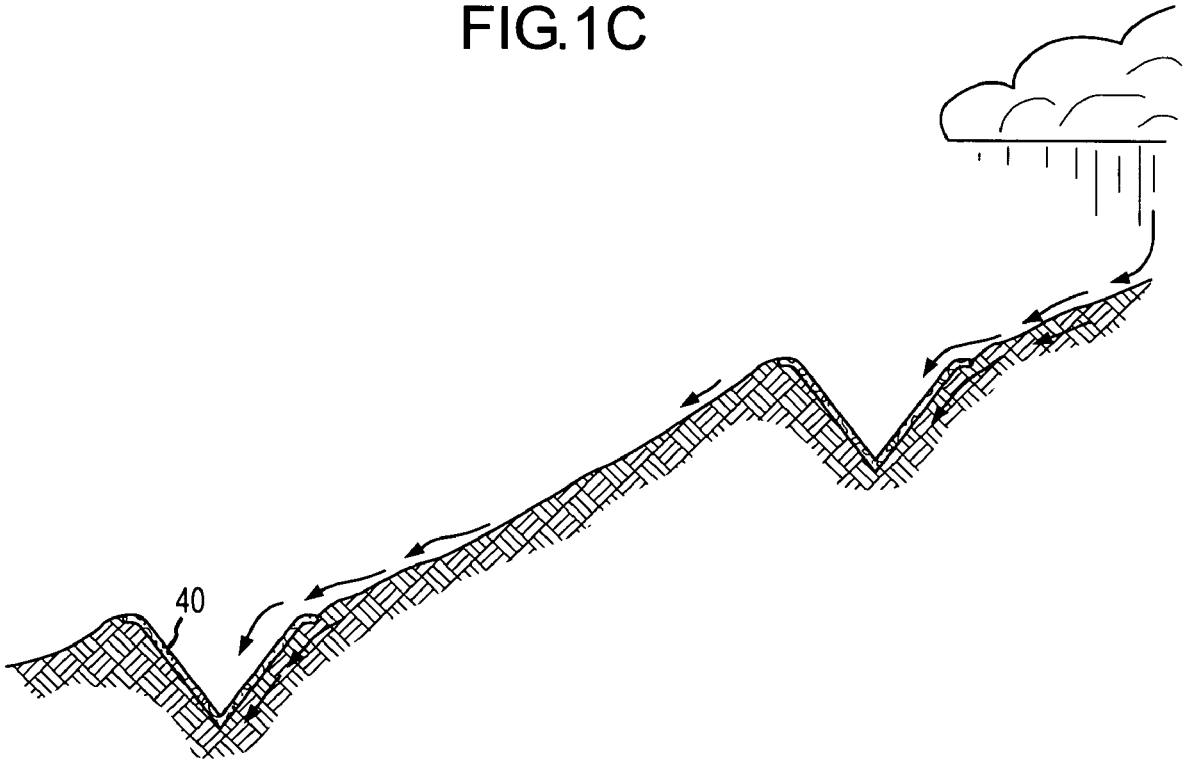
FIG. 1D is an end cut-away end view of a hillside showing water flow from rain passing two concrete ditch liners.

As shown in FIGS. 1A–7, an interlockable drainage system 10 is provided that in its broadest context includes two or more liner sections 12*a–n* insertable into a lined or unlined ditch 14 as shown in FIGS. 1A–1B. Liner sections 12*a–b* as perhaps best shown in FIG. 2A include a plurality of corrugations 16*a–n* formed between opposing ends 18*a–d* of liner sections 12*a–b* that in one embodiment are asymmetrical quadrilateral plates 20*a–n* joined by alternating parallel ridges 22*a–n* and nonparallel grooves 24*a–n* best shown in FIG. 7.

Figure 2A:
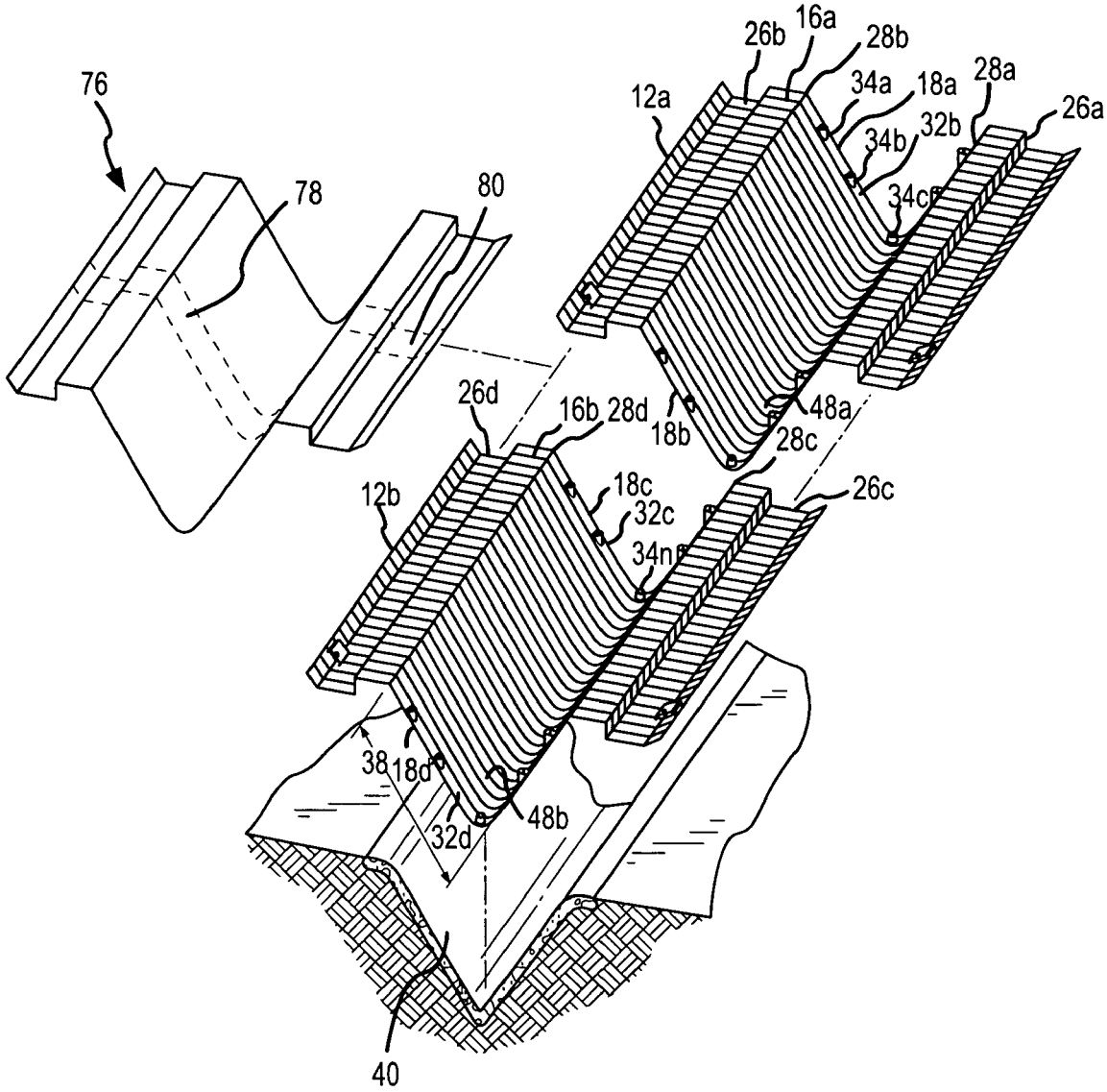
FIG. 2A is a perspective view of an uninstalled interlockable drainage system about to be installed in a concrete lined ditch.

Interlockable drainage system 10 also includes a flared channel 26*a–b* that extends from opposing edges 28*a–b* of liner sections 12*a–b* as best shown in FIG. 2A. Flared channel 26*a–b* is useful not only for reducing erosion adjacent ditch 14 in which interlockable drainage system 10 is installed, but also provides means 30' for inserting one or more anchors 30*a–n* for securing liner sections 12*a–b* in place as best shown in FIGS. 3B–5B.

Figure 2B:
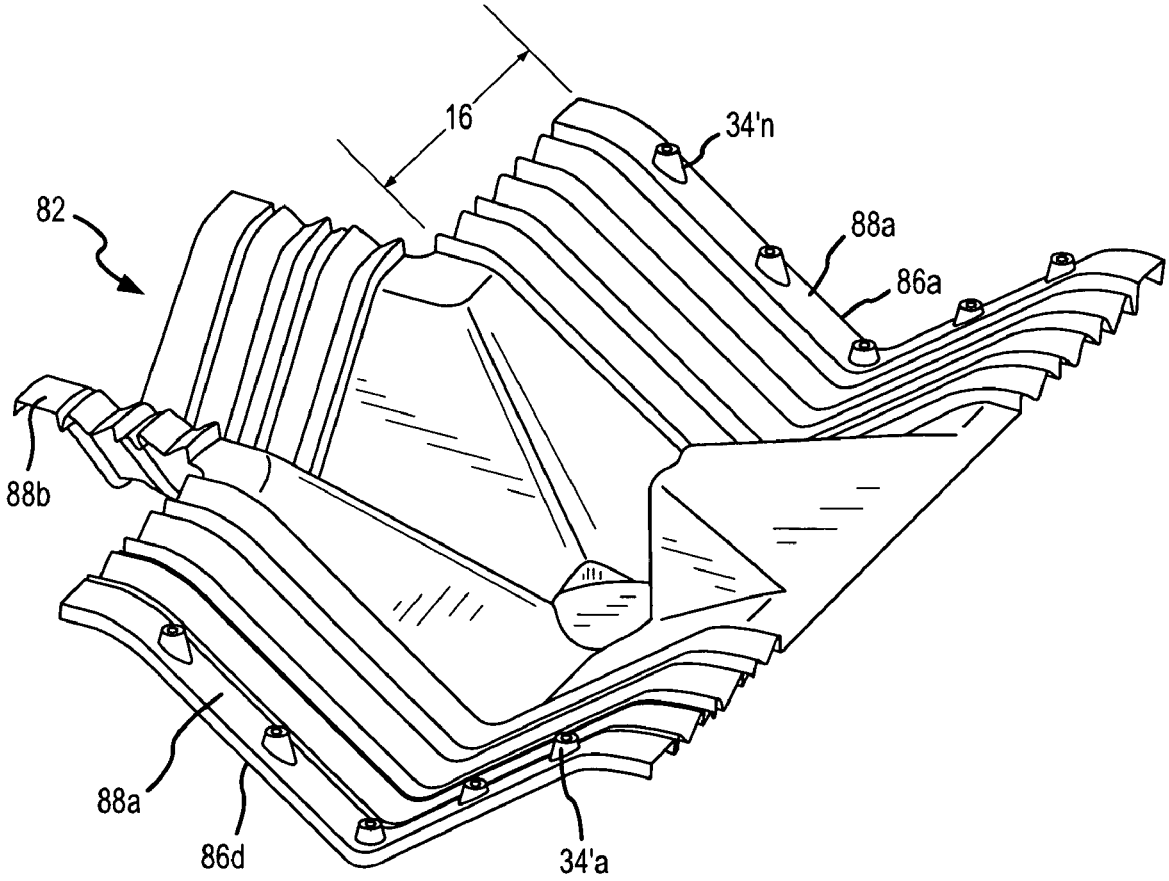
FIG. 2B is a perspective view of one embodiment of a hub assembly of the interlockable drainage system.
Figure 2C:
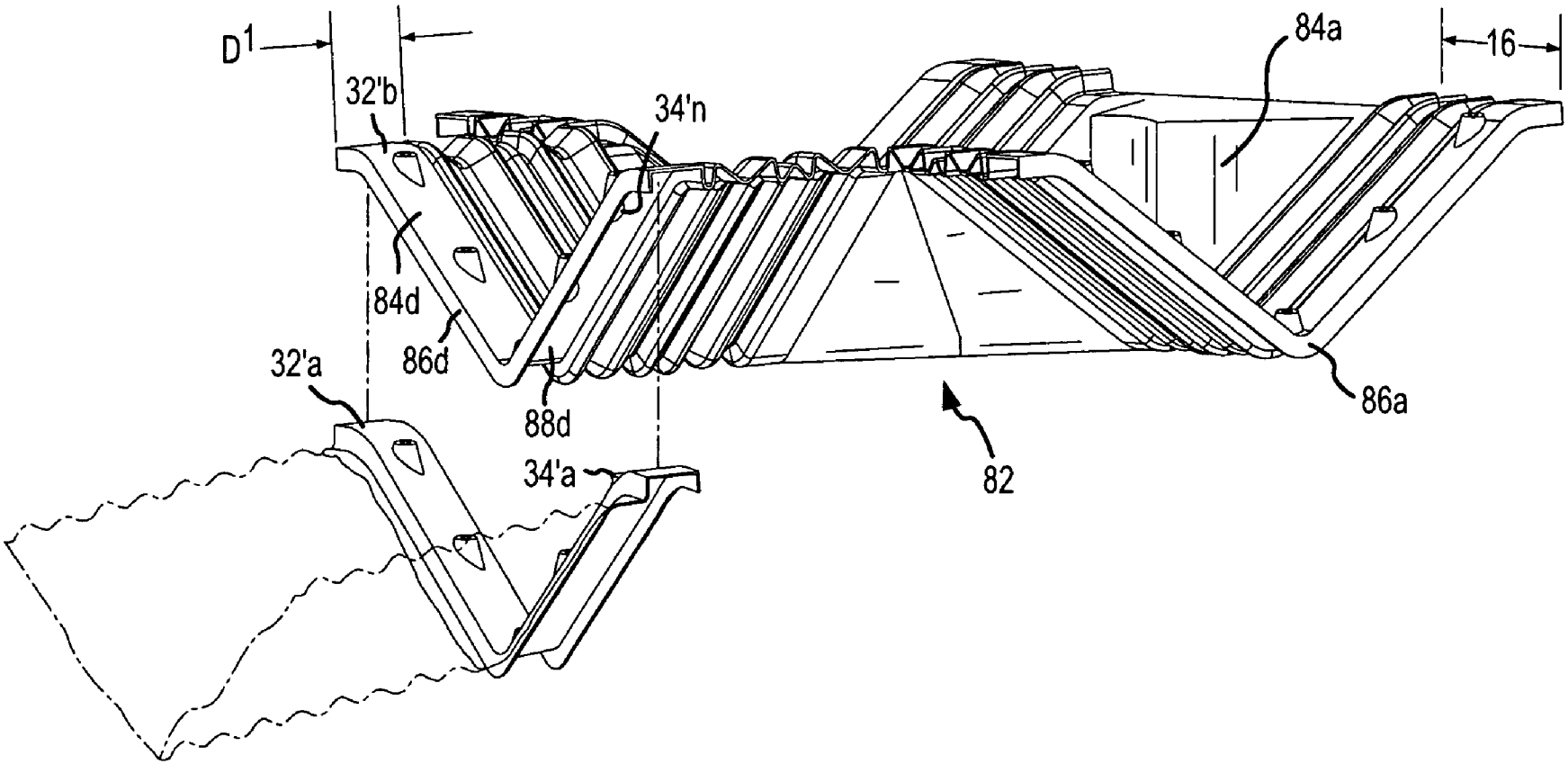
FIG. 2C is a perspective exploded view of the hub assembly of the interlockable drainage system and cut-away portion of ditch liner connectable to the hub assembly.
Figure 5A:
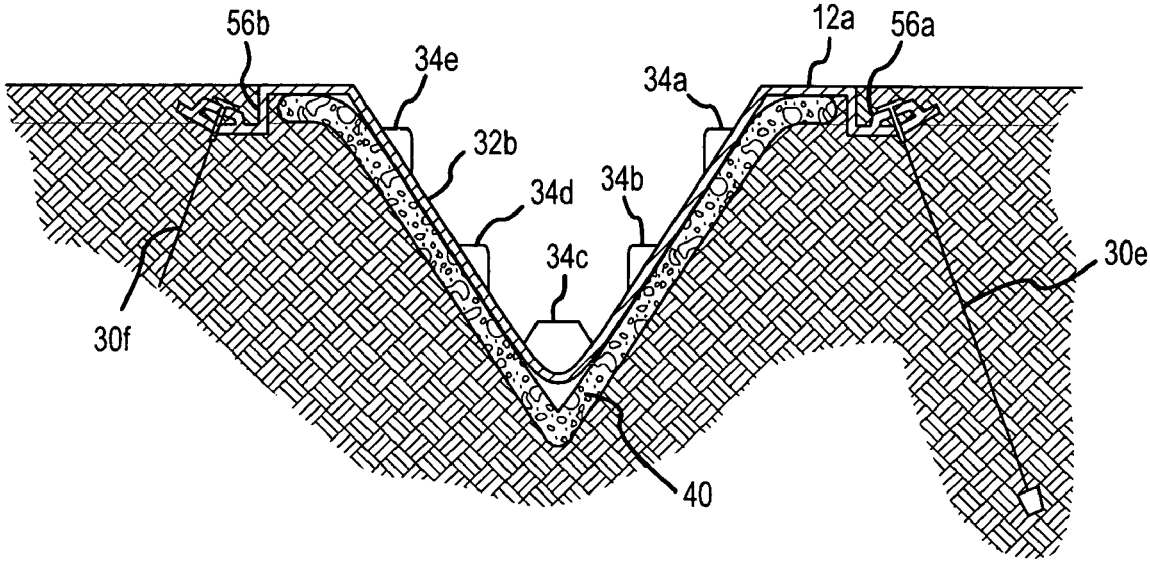
FIG. 5A is an end view of a liner section shoulder showing a plurality of bosses formed on the shoulder of the liner section.
Figure 5B:
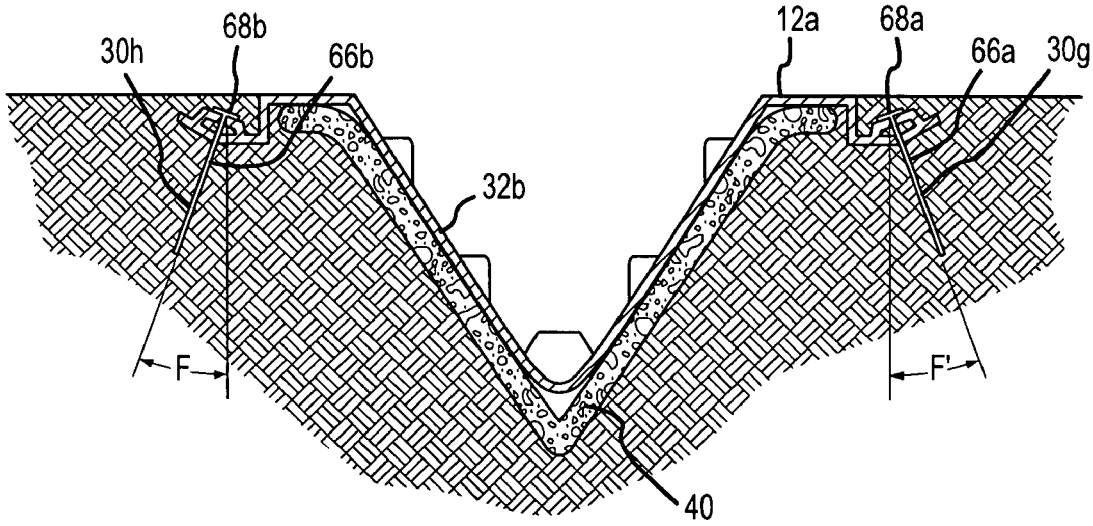
FIG. 5B is an end view of a liner section shoulder showing a plurality of bosses formed on the shoulder of the liner section and an alternative embodiment of a anchors.

As best shown by cross-reference between FIGS. 2C and 5A–5B, a shoulder 32*a–n* is formed in opposing ends 18*a–b* of liner sections 12*a–b*. A plurality of bosses 34 is formed on shoulder 32*a–b*. Plurality of bosses 34*a–n* on one shoulder 32*a* is provided for compressibly connecting plurality of bosses 34 to another shoulder 32*b*, thus interlocking one liner section 12*a* to another liner section 12*b*. A connector 36, best shown in FIG. 6, may be used for interconnecting plurality of bosses 34.

Figure 2D:
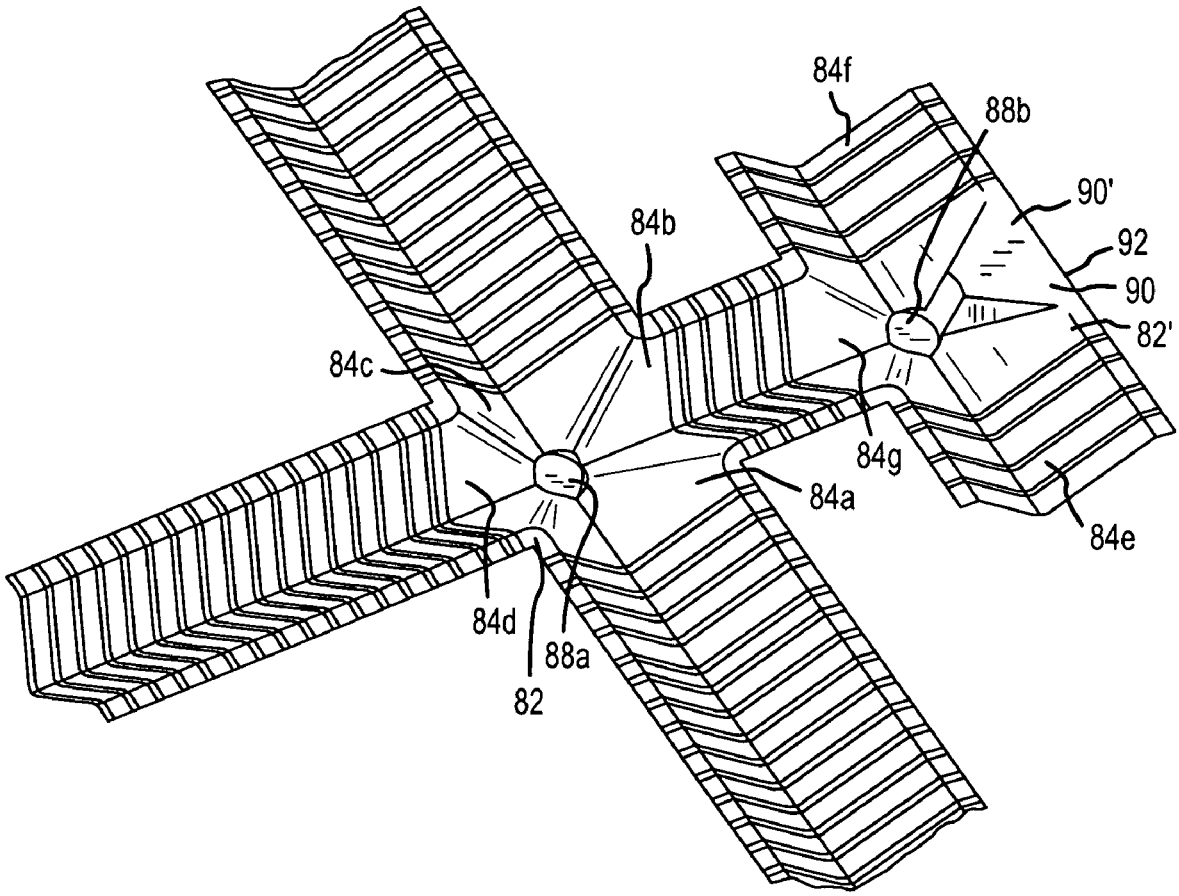
FIG. 2D is a perspective view of an alternative embodiment of two hub assemblies.
Figure 3A:
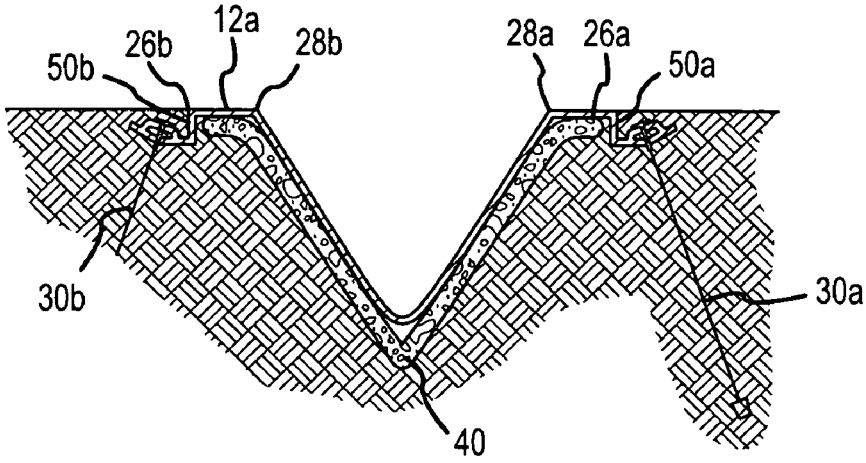
FIG. 3A is an cut-away view of a ditch liner of the interlockable drainage system installed in a concrete ditch shown without bosses to emphasize other features of the liner components.

More specifically, as shown by cross-reference between FIGS. 2A and 3A, interlockable drainage system 10 includes two or more liner sections 12*a–b*. Each liner section 12*a–b* of interlockable drainage system 10 is formed with a spaced-apart open span 38 defined by opposing edges 28*a–n* that are substantially parallel to the longitudinal axis of each of two or more liner sections 12*a–b*. In the embodiment shown in FIGS. 2A and 3A, two or more liner sections 12*a–b* are formed with a generally V-shaped cross-section. The generally V-shaped cross-section is to accommodate and fit into a pre-existing concrete ditch liner 40 formed with a V-shaped cross-section as shown by cross-reference between FIGS. 2A–5B. As will be evident to one skilled in the art, interlockable drainage system 10 may be shaped to accommodate or fit into a variety of ditches 14 regardless of cross-section shape. As shown, two or more liner sections 12*a–b* is molded from polyethylene with anti-ultra violet resistant characteristics and fire-resistant characteristics. The material also is chosen to provide excellent friction factors in connection with water movement. Because of the materials used to manufacture the liner sections and methods of manufacture, the two or more liner sections 12*a–b* may be colored to match different terrains and environments to enhance the aesthetics of an installation.

In the embodiment shown in FIGS. 2A and 3A, two or more liner sections 12*a–b* are thermoformed polyethylene liner sections. Two or more liner sections are formed of Medium Density Polyethylene ("MDPE") material. Polyethylene and similar thermoplastic materials are unpalatable to rodents that otherwise might bore holes through two or more liner sections 12*a–b*. Thermoplastic materials also are highly resistant to heat and fire. Such materials also contribute to rigidity, force resistance, lightness, and environmental acceptance. Nova Chemical NOVAPOL™ provides at least one commercial formulation of the polyethylene. TR-0535-UGhexene MDPE. As a person skilled in the art will also appreciate, however, two or more liner sections 12*a–b* made of other materials also may be appropriate in other circumstances, environments, and conditions. Accordingly, a variety of resins, plastics, and other materials may be used as materials in making interlockable drainage system 10.

As indicated, two or more liner sections 12*a–b* may be formed by thermoforming. Thermoforming is a method of manufacturing plastic and resin products by preheating a flat sheet of plastic, then bringing the sheet in contact with a mold whose shape the sheet takes. This may be done by vacuum, pressure, or direct mechanical force. Injection molding also may be used by heating pellets or granules of plastic until melted. The melted material is forced into a split-die chamber, or mold, and allowed to cool and cure into desired shapes. The mold then is opened and the part ejected. As a person skilled in the art also will appreciate, however, two or more liner sections 12*a–b* may be made by any number of other methods, including rotational molding. The method of manufacturing of two or more liner sections 12*a–b* is not a limitation of this disclosure or of the claims.

Plurality of corrugations 16 is formed between opposing ends 18*a–b* of two or more liner sections 12*a–b*. In the embodiment shown by cross-reference between FIGS. 2A and 7, plurality of corrugations 16 includes asymmetrical quadrilateral plates 20*a–n*. As also shown perhaps best in the embodiment shown in FIGS. 3A and 7, plurality of asymmetrical quadrilateral plates 20*a–n* have a leading border 42 and a trailing border 44. Asymmetrical quadrilateral plates 20*a–n* are sequentially joined at leading border 42 and trailing border 44 by substantially parallel ridges 22*a–n* and substantially nonparallel grooves 24*a–n*. More specifically, plurality of asymmetrical quadrilateral plates 20*a–n* also is joined at sequentially alternating substantially parallel ridges 20*a–n* and substantially nonparallel grooves 24*a–n*.

Plurality of asymmetrical quadrilateral plates 20*a–n* includes at least two substantially right angles. The at least two substantially right angles A and B are formed adjacent substantially parallel ridges 22*a–n*, shown diagrammatically in FIG. 7 as Angles A and B. As also shown, plurality of asymmetrical quadrilateral plates 20-*a–n* includes at least two angles that not only are not right angles, but also are not equal angles, as shown diagrammatically in FIG. 7 as Angles C and D. The use of corrugations 16 formed as asymmetrical quadrilateral plates 20*a–n* contributes to the mechanical advantages of interlockable drainage system 10. The mechanical advantages include at least dampening rapid flow of undesirable fluid and materials through interlockable drainage system 10. Another mechanical advantage is interrupting or trapping the flow of silt, dirt, and similar matter within corrugations 16, while also providing alternating scoops 46*a–n* to slow the rate of movement of such matter by providing a means for gradual passage of the matter through and over alternating scoops 46*a–n* aligned transversely to the longitudinal axes through interlockable drainage system 10. Asymmetrical quadrilateral plates 20*a–n* also affect the coefficient of friction otherwise provided by two or more liner sections 12*a–n*, and accordingly the rate of flow through interlockable drainage system 10.

The inner surface 48*a–b* of two or more liner sections 12*a–b* is thus formed for flow enhancement and control by selection of the proper combination of materials and the configuration of corrugations 16. The term "flow enhancement and control" as used in this document refers to the fact that inner surface 48*a–b* of one or more liner sections 12*a–b* is shaped and formed to permit passage across and through interlockable drainage system 10 of undesirable fluids and materials sought to be conveyed from one location to another. The term "flow enhancement and control" also means that inner surface 48 of a liner section 12 is shaped and formed to inhibit flow blockage across and through interlockable drainage system 10 that might otherwise be caused by solid materials ceasing to flow through the interlockable drainage system 10 for any reason.

Figure 3B:
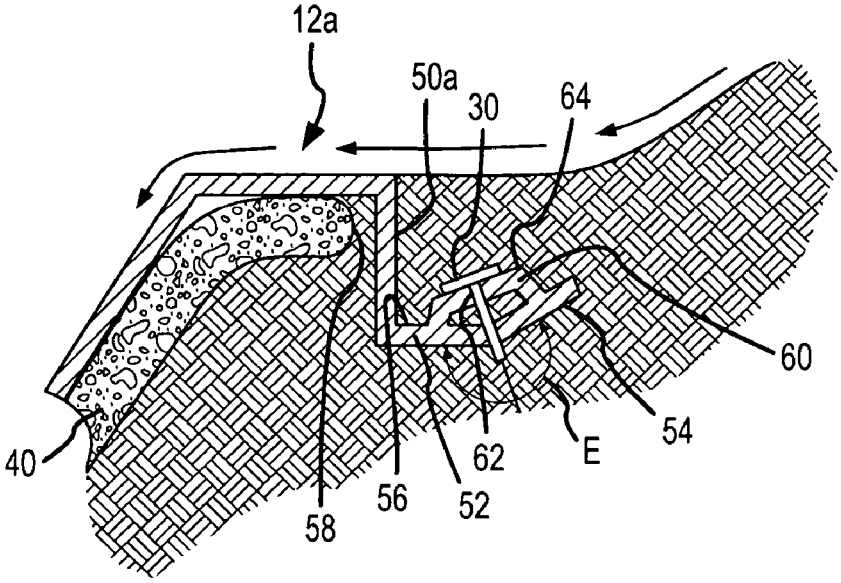
FIG. 3B is an end view showing greater detail of an anchor inserted through a liner section.

A flared channel 26*a–b* is provided in interlockable drainage system 10. In the embodiment shown by cross-reference between FIGS. 2A–5B, flared channel 26*a–b* monolithically extends from opposing edges 28*a–b* of one or more liner sections 12*a–b*. Flared channel 26*a–b* includes a substantially L-shaped arm 50*a–b* as perhaps best shown in FIGS. 3A and 3B. Flared channel 26*a–b* also includes a foot 52 extending from substantially L-shaped arm 50*a–b*. Flared channel 26*a–b* includes an angled flange 54 extending from foot 52. Flared channels 26*a–b* provide the mechanical advantage of a duct 56 into which dirt and other materials may be mounded and compressed to provide a barrier for resisting seepage and erosion of soil adjacent concrete liner 40, as best shown in FIGS. 3A–4, and because L-shaped arm 50*a–b* is designed to tuck over the lip 58 of concrete liner 40 before backfill of the dirt and other materials.

Figure 4:
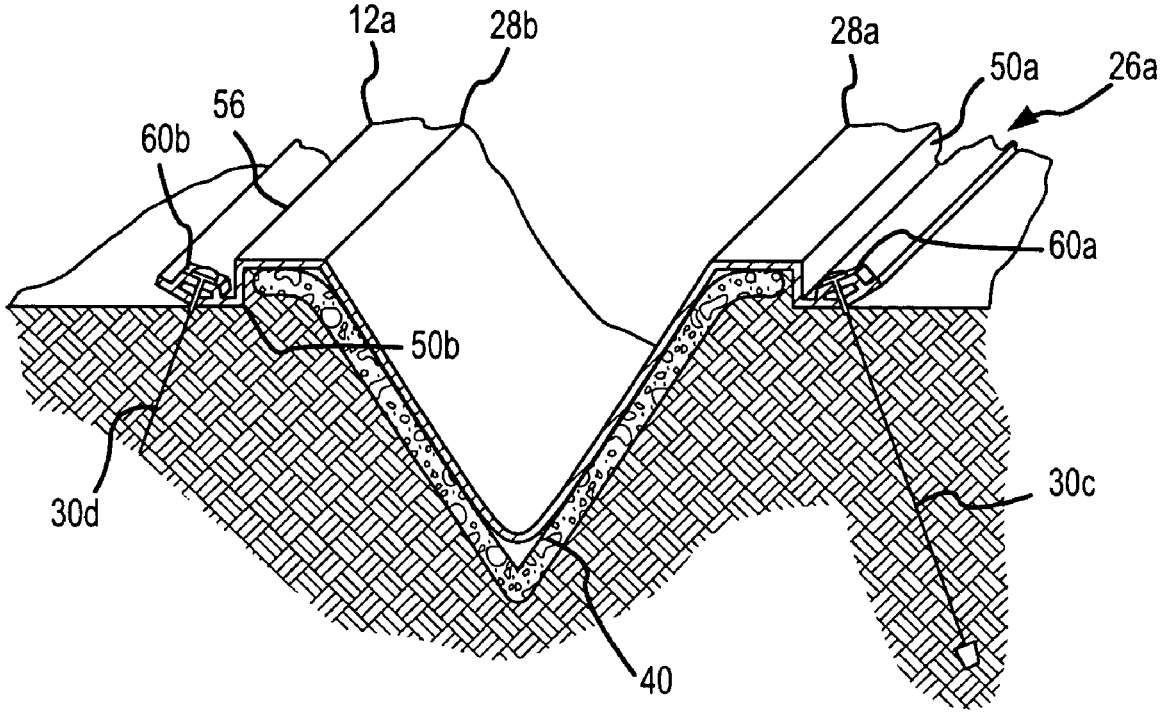
FIG. 4 is a perspective end view showing an anchor inserted through a liner section shown without bosses to emphasize other features of the liner components.

In the embodiment shown in FIGS. 2A and 3A–4, flared channel 26*a–b* also includes an inclined bracket 60*a–n* formed with a hole 62. Inclined bracket 60*a–n* formed with a hole 62 is shown in FIGS. 3A and 3B as installed at the intersection of the angle formed between foot 52 and angled flange 54. The angle formed between foot 52 and angled flange 54*a–b* is shown diagrammatically in FIG. 3A as Angle E. Inclined bracket 60*a–n* formed with hole 62 provides the mechanical advantage of including an opening provided by hole 62 through which anchor 30 may be aligned and guided for insertion through one or more liners 12*a–b*. Inclined bracket 60*a–n* formed with hole 62 also provides the mechanical advantage of a guide facet 64. Guide facet 64 is angled for properly inserting anchor 30 at the most effective angle through inclined bracket 60*a–n* into soil or other material adjacent concrete liner 40. The soil or other material adjacent concrete liner 40 is perhaps best shown by cross-reference between FIGS. 3A–5B as a cross-hatched pattern. As will be evident to one skilled in the art, and as shown in FIG. 4, inclined bracket 60*a–b* in opposing flared channels 26*a–b* are aligned in different orientations, thus providing a more movement resistant installation on insertion of anchors 30 shown in FIG. 4 as anchors 30*c–d*.

In the embodiment shown in FIG. 5A, one or more anchors 30 is insertable through the flared channel 26*a–b* and inclined bracket 60*a–n* for securing two or more liners 12*a–b* in concrete ditch liner 40. In the embodiment shown in FIG. 5A, one or more anchors 30*e–f* is an earth anchor. The term "earth anchor" refers to an anchor manufactured under the trademark PLATIPUS® by Platipus Anchors Limited located in Surrey, England. As will be evident to one skilled in the art, any of a variety of anchors 30 may be used. In the embodiment shown in FIG. 5B, for example, one or more anchors 30*a–n* is a rod 66*a–b*. Rod 66*a–b* is shown to include a stopper 68. Stopper 68*a–b* not only secures rod 66*a–b* against guide facet 64*a–b* of inclined bracket 60*a–b*, but also contributes to orienting the angle of incidence of rod 66*a–b* at the proper angle for insertion through inclined bracket 60*a–b*, shown diagrammatically in FIG. 5B as Angle F and F'.

Figure 6:
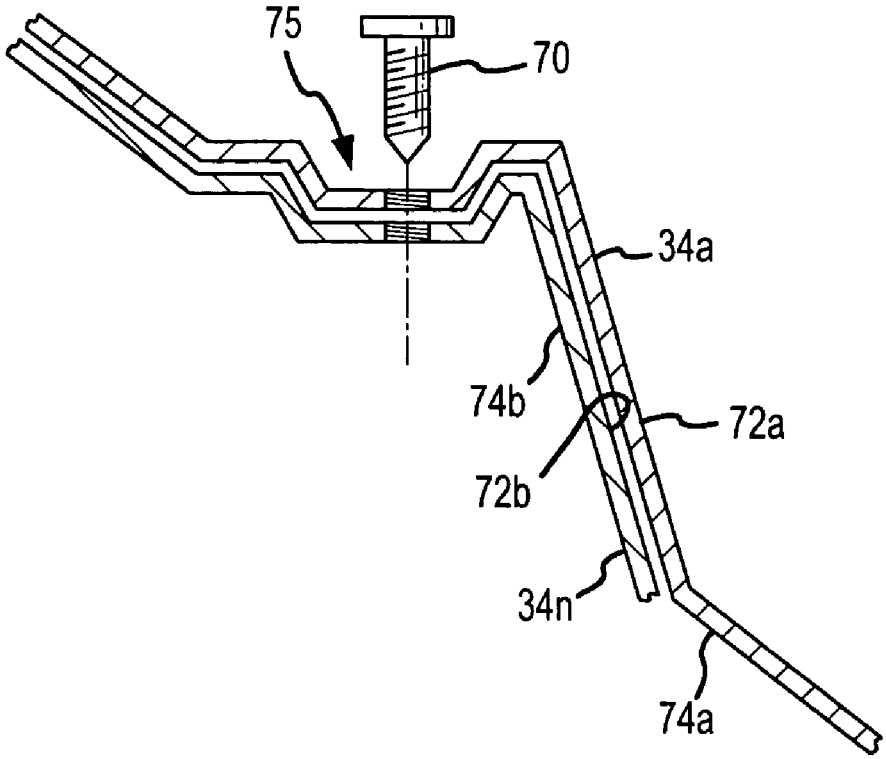
FIG. 6 is a cut-away side view of bosses connectable by a connector.

As shown in FIGS. 2A–2B and 5A–5B, in one embodiment of interlockable drainage system 10 shoulders 32*a–b* are formed in opposing ends 18*a–d* of two or more liner sections 12*a–b*. A plurality of bosses 34*a–n* is monolithically formed on shoulder 32*a–b* in opposing ends 18*a–b* of two or more liner sections 12*a–b*. A connector 70 as best shown in FIG. 6 is provided for interconnecting plurality of bosses 34*a–n*. As shown in FIG. 6, connector 70 may be threadably inserted through exterior surface 72*a* and through exterior surface 72*b* using a connector 70 that does not make contact with or puncture any other portion of liner sections 12*a–n*. In the embodiment shown in FIGS. 2C and 6, plurality of bosses 34 is substantially hollow. Plurality of bosses 34 also is formed with an exterior surface 72 and an interior surface 74. Exterior surface 72 of plurality of bosses 34 is slidably and compressibly connectable and engageable with interior surface 74 of bosses in an opposing shoulder 32*b*.

The mechanical advantage of a slidably connectable and engageable interior surface 74 and exterior surface 72 includes at least providing means for quickly, easily, and compressible interconnecting bosses 34*a–n* for a secure fit that avoids seepage or leakage from interlockable drainage system 10. As shown in FIG. 2B, plurality of bosses 34*a–n* is formed as a substantially frusto-conical member formed with a recess 75. But as will be evident to one skilled in the art, the shape of plurality of bosses 34*a–n* is not a limitation of interlockable drainage system 10, and may include not only a frusto-conical member, but include a variety of cross-sectional variations including, by way of a non-exclusive example, a hexagonal cross-section.

Alternative means for compressibly connecting opposing ends 18*a–b* of liner sections 12*a–b* are available but not shown. Alternative connecting means include a first locking channel segment monolithically formed substantially adjacent one end of the two or more flexible liner sections. Connecting means also includes a second locking channel segment monolithically formed substantially adjacent the other end of the two or more flexible liner sections, and further wherein the second locking channel segment is detachably connectable to the first locking channel segment. The alternative means for compressibly connecting opposing ends of liner sections is shown and claimed in U.S. Pat. No. 6,692,186 B1 issued to one of the named inventors named in this document on Feb. 17, 2004, shown in FIGS. 3A–3C and at column 13, lines 8–16, column 13, lines 61–64, and column 14, lines 38–46, the provisions of which are incorporated by reference into this document.

Yet another means for compressibly connecting opposing ends of liner sections 12*a–b* is available. Means for compressibly connecting opposing ends of liner sections includes a first locking channel segment monolithically formed substantially adjacent one end of the two or more flexible liner sections. Means also includes a second locking channel segment monolithically formed substantially adjacent the other end of the two or more flexible liner sections, and further wherein the second locking channel segment is detachably connectable to the first locking channel segment. The alternative means for compressibly connecting opposing ends of liner sections is shown and claimed in U.S. Pat. No. 6,722,818 B1 issued to one of the named inventors named in this document on Apr. 20, 2004, at FIGS. 4–6, and in column 9, lines 23–37, column 10, lines 1–12, and column 10, lines 50–64, the provisions of which are incorporated by reference into this document.

In the embodiment shown in FIG. 2A, an adjustable elbow unit 76 is included with interlockable drainage system 10. Adjustable elbow unit 76 is removably connectable to opposing ends 18*a–b* of two or more sequential liner sections 12*a–b* in an interlocked interlockable drainage system 10 for changing the direction of flow of the undesirable fluids and materials through interlockable drainage system 10. Adjustable elbow unit includes a pleat 78. Pleat 78 provides the resiliency and flexibility of a living hinge in the form of a band 80 that interrupts the sequence of asymmetrical corrugations 20*a–n*, and is but one embodiment that may or may not be corrugated. Pleat 78 in adjustable elbow unit 76 provides the mechanical advantage of flexibility and bendability to accommodate changes in direction of an installed interlockable drainage system 10 either along the longitudinal axes of liner sections 12*a–b* joined by adjustable elbow unit 76 or along the transverse direction substantially perpendicular to the longitudinal axes. As shown, pleat 78 in adjustable elbow unit 76 provides the desired flexibility and bendability to alter direction of an installed interlockable drainage system 10, but the mechanism for doing so may be any of a variety of mechanisms. One such alternative mechanism may be a crinkled accordion configuration (not shown). Another such alternative mechanism may be a series of uniform variously shaped corrugations formed in pleat 78 (not shown).

Figure 7:
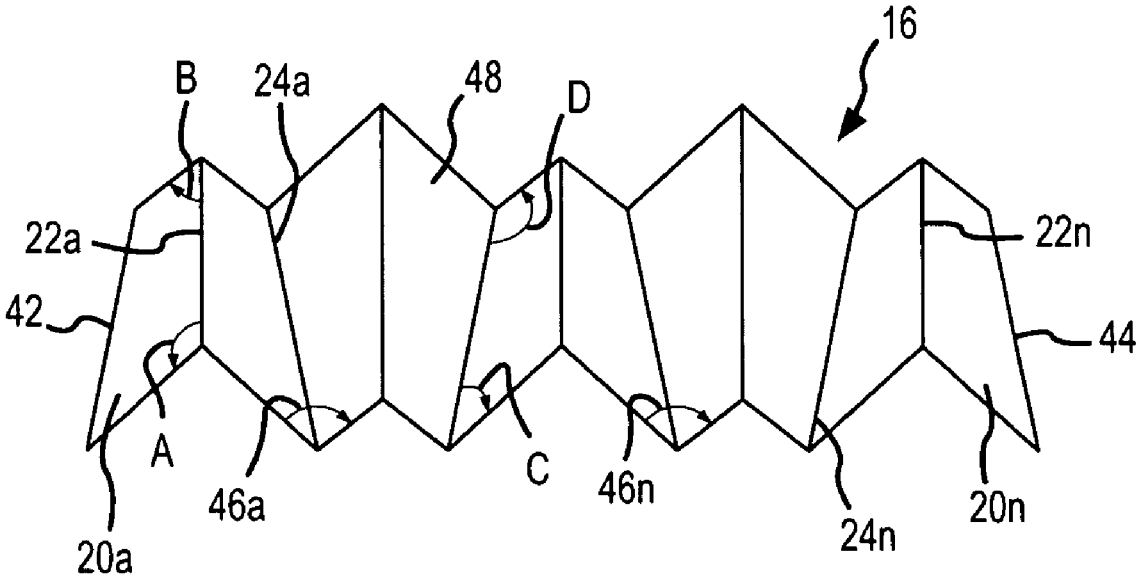
FIG. 7 is a diagrammatic view of the asymmetrical plates used for forming the corrugations of the liner sections of the interlockable drainage system.

Other embodiments are shown in FIGS. 2B–2D for changing the direction of flow of the undesirable fluids and materials through interlockable drainage system 10. As shown in FIG. 2C, interlockable drainage system 10 includes a hub 82. Hub 82 includes one or more passages 84*a–d* formed with a distal end 86*a–n*. A shoulder extension 88*a–n* adjacent distal end 86*a–n* is formed in one or more passages 84*a–d* extending a distance $D^1$ from distal end 86*a–n* toward center 88 of hub 82 as shown in FIG. 2D. A plurality of bosses 34'*a–n* is monolithically formed on shoulder extension 88*a–n* for slidably interconnecting plurality of bosses 34*a–n* on shoulders 32*a–n* of liner sections 12*a–n* to plurality of bosses 34'*a–n* formed on shoulder extension 88*a–n*. Connector 70 as shown in FIG. 7 may be used to further connect plurality of bosses 34*a–n* on shoulders 32*a–n* of liner sections 12*a–n* to plurality of bosses 34'*a–n* on sho extension 88*a–n*.

As also shown in FIGS. 2B–2D, hub 82 may be provided with a varying number of passages 84*a–d* for affecting the direction of flow through interlockable drainage system 10. FIG. 2D, for example, shows one hub 82 with four passages 84*a–d* connectable to a second hub 82' having three passages 84*e–g*. Hub 82' also is shown with a means 90 for splitting or interrupting the flow of undesirable fluids and materials through interlockable drainage system 10. As shown, means 90 is a wedge 90' extending toward center 88 of a second hub 82' from a closed end 92 of hub 82'. The flow of undesirable fluids and materials, for example, from passage 84*f* in the direction of passage 84*e* may be slowed, interrupted, and redirected by wedge 90'. As will be evident to one skilled in the art, wedge 90' is only one of several means 90 for affecting the direction of flow through interlockable drainage system 10. It also will be evident to one skilled in the art that alternative means may be used other than bosses 34'*a–n* for compressibly connecting opposing ends 18*a–n* of two or more liner sections 12*a–n*. Such alternative means have been described in this document by reference to U.S. Pat. No. 6,692,186 B1, issued Feb. 17, 2004, and to U.S. Pat. No. 6,692,186 B1, issued Feb. 17, 2004.

The interlockable drainage system 10 shown in drawing FIGS. 1 through 7 is at least one embodiment that is not intended to be exclusive, but merely illustrative of the disclosed but non-exclusive embodiments. Claim elements and steps in this document have been numbered and/or lettered solely as an aid in readability and understanding. Claim elements and steps have been numbered solely as an aid in readability and understanding. The numbering is not intended to, and should not be considered as intending to, indicate the ordering of elements and steps in the claims. Means-plus-function clauses in the claims are intended to cover the structures described as performing the recited function that include not only structural equivalents, but also equivalent structures. Thus, although a nail and screw may not be structural equivalents, in the environment of the subject matter of this document a nail and a screw may be equivalent structures.

What is claimed is:

1. An interlockable drainage system for transporting undesirable fluids and materials, comprising:

two or more liner sections having a generally V-shaped cross-section formed with opposing ends;

a plurality of corrugations monolithically formed between the opposing ends of the two or more liner sections, wherein the plurality of corrugations are asymmetrical quadrilateral plates sequentially joined;

a flared channel monolithically extending from the two or more liner sections;

one or more anchors insertable through the flared channel for securing a location of the two or more liner sections;

a shoulder formed in the opposing ends of the two or more liner sections;

a plurality of bosses monolithically extending from the shoulder for compressibly connecting the two or more liner sections; and a connector for interconnecting the plurality of bosses.

2. An interlockable drainage system for transporting undesirable fluids and materials as recited in claim 1, further comprising an adjustable elbow unit removably connectable to the two or more liner sections for flexibly and bendably changing the direction of flow of the undesirable fluids and materials through the system.

3. An interlockable drainage system for transporting undesirable fluids and materials as recited in claim 1, wherein the flared channel includes a substantially L-shaped arm.

4. An interlockable drainage system for transporting undesirable fluids and materials as recited in claim 3, wherein the flared channel includes a foot extending from the substantially L-shaped arm.

5. An interlockable drainage system for transporting undesirable fluids and materials as recited in claim 4, wherein the flared channel includes an angled flange extending from the foot.

6. An interlockable drainage system for transporting undesirable fluids and materials as recited in claim 5, wherein the flared channel includes an inclined bracket formed with a hole mounted at the intersection of the angle formed between the foot and the angled flange for positioning the one or more anchors.

7. An interlockable drainage system for transporting undesirable fluids and materials as recited in claim 1, wherein the one or more anchors is an earth anchor.

8. An interlockable drainage system for transporting undesirable fluids and materials as recited in claim 1, wherein the one or more anchors is a rod.

9. An interlockable drainage system for transporting undesirable fluids and materials as recited in claim 1, wherein the plurality of bosses further comprises a recess for locating and inserting the connector.

10. An interlockable drainage system for transporting undesirable fluids and materials as recited in claim 1, wherein the connector is selected from the group of connectors consisting of rivets, nails, screws, staples, nuts and bolts.

11. A drainage assembly, comprising:

a plurality of thermoformed polyethylene liner sections for lining a ditch having opposing ends and opposing edges;

a series of asymmetrical corrugations formed in the plurality of thermoformed polyethylene liner sections, wherein the series of asymmetrical corrugations includes a plurality of quadrilateral plates having only two substantially right angles;

at least two flared channels formed in the opposing edges for providing an anchoring and erosion suppression device;

an anchor insertable through the at least two flared channels for securing the plurality of thermoformed polyethylene liner sections in the ditch;

means for compressibly connecting opposing ends of the plurality of thermoformed polyethylene liner sections; and a hub assembly compressibly connectable to the compressibly connecting means.

12. A drainage assembly as recited in claim 11, wherein the plurality of quadrilateral plates is joined monolithically at alternating substantially parallel ridges and substantially nonparallel grooves.

13. A drainage assembly as recited in claim 12, wherein the plurality of quadrilateral plates include at least two angles that are neither right angles nor equal angles.

14. A drainage assembly as recited in claim 11, wherein the compressibly connecting means includes a first shoulder formed in one of the opposing ends of the plurality of thermoformed polyethylene liner sections, and a second shoulder formed in the other of the opposing ends of the plurality of thermoformed polyethylene liner sections.

15. A drainage assembly as recited in claim 14, wherein the compressibly connecting means includes one or more substantially hollow bosses formed on the first shoulder and on the second shoulder.

16. A drainage assembly as recited in claim 15, wherein the one or more substantially hollow bosses is formed with an exterior surface and an interior surface.

17. A drainage assembly as recited in claim 16, wherein the exterior surface of the one or more substantially hollow bosses on the second shoulder is slidably connectable with the interior surface of the one or more substantially hollow bosses on the first shoulder.

18. A drainage assembly as recited in claim 17, wherein the compressibly connecting means further comprises one or more connectors.

19. An apparatus for transporting fluids and materials, comprising:

two or more liner sections shaped for removable placement in a ditch, wherein the two or more liner sections include corrugations;

means for anchoring the two or more liner sections in the ditch;

a plurality of opposing channels extending from the two or more liner sections, wherein the plurality of opposing channels include an L-shaped extension, and further wherein the plurality of opposing channels include at least one inclined bracket formed with a hole for guiding insertion of the anchoring means; and means for connecting the two or more liner sections.

20. An apparatus for transporting fluids and materials as recited in claim 19, further comprising means attachable to the two or more liner sections for directing the fluids and materials in varying directions.

21. An apparatus for transporting fluids and materials as recited in claim 19, wherein the anchoring means includes a rod insertable through the at least one inclined bracket formed with a hole.

22. An apparatus for transporting fluids and materials as recited in claim 19, wherein the connecting means includes a series of bosses formed in the two or more liner sections.

23. An apparatus for transporting fluids and materials as recited in claim 19, wherein the connecting means includes a first locking channel segment monolithically formed substantially adjacent one end of the two or more liner sections.

24. An apparatus for transporting fluids and materials as recited in claim 23, wherein the connecting means includes a second locking channel segment monolithically formed substantially adjacent the other end of the two or more liner sections, and further wherein the second locking channel segment is detachably connectable to the first locking channel segment.

25. An apparatus for transporting fluids and materials as recited in claim 19, wherein the connecting means includes a compressibly connectable member monolithically formed adjacent one end of the two or more liner sections.

26. An apparatus for transporting fluids and materials as recited in claim 25, wherein the connecting means includes a coupling channel engageble with the compressibly connectable member.

27. A method for transporting fluids and materials through a ditch, comprising:

selecting a material for molding two or more liner sections that are positionable in the ditch;

forming from the material two or more liner sections;

shaping the two or more liner sections to include a plurality of asymmetric corrugations monolithically formed between opposing ends of the two or more liner sections;

forming in the two or more liner sections opposing channels having an inclined bracket formed with a hole;

providing one or more anchors for securing the two or more liner sections in the ditch;

shaping the opposing ends of the two or more liner sections into opposing shoulders;

extending from the opposing shoulders a plurality of bosses for compressibly connecting the two or more liner sections; and selecting a connector for demountably interconnecting the plurality of bosses.

28. A method for transporting fluids and materials through a ditch as recited in claim 27, wherein the material selecting step includes the substep of selecting a material from the group of materials selected from polyethylene, resins, and plastics.

29. A method for transporting fluids and materials through a ditch as recited in claim 27, wherein the two or more liner sections shaping step further comprises the substep of configuring the cross-section of the two more liner sections substantially in the form of the cross-sectional shape of the ditch.

30. A method for transporting fluids and materials through a ditch as recited in claim 27, wherein the liner sections shaping step includes the substeps of:

forming an interconnected plurality of asymmetrical corrugations in the liner sections shaped as asymmetrical quadrilateral plates;

joining the asymmetrical quadrilateral plates at a ridge substantially perpendicular to the longitudinal axis of each of the liner sections;

joining the asymmetrical quadrilateral plates at a groove that is not substantially perpendicular to the longitudinal axis of each of the liner sections;

shaping the asymmetrical quadrilateral plates to include two substantially right angles adjacent each ridge; and shaping the asymmetrical quadrilateral plates to include at least two angles adjacent each groove that are neither right angles nor equal angles.

31. A method for transporting fluids and materials through a ditch as recited in claim 27, wherein the opposing channel forming step includes the substeps of:

shaping the material to include a substantially L-shaped arm monolithically attached to opposing edges of the two or more liner section;

extending from the L-shaped arm a foot;

extending from the foot an angled flange; and installing the inclined bracket formed with a hole in the intersection of the angle formed between the foot and the angled flange for positioning the one or more anchors.

32. A method for transporting fluids and materials through a ditch as recited in claim 27, wherein the connector selecting step includes the substep of selecting a connector selected from the group of connectors consisting of nails, rivets, screws, staples, nuts and bolts.

* * * * *